US005958184A

United States Patent [19]

Kanada et al.

[11] Patent Number: 5,958,184

[45] Date of Patent: Sep. 28, 1999

[54] PROCESS FOR PRODUCING THIOUREA DIOXIDE

[75] Inventors: Toshiaki Kanada; Seikyu Jinnouchi; Masafumi Shimpo; Tetsuo Koshitsuka; Akiko Kimura, all of Tokyo, Japan

[73] Assignee: Mitsubishi Gas Chemical Company Inc., Tokyo, Japan

[21] Appl. No.: 09/015,627

[22] Filed: Jan. 29, 1998

Related U.S. Application Data

[62] Division of application No. 08/788,027, Jan. 23, 1997, abandoned, which is a continuation of application No. 08/539,824, Oct. 6, 1995, abandoned, which is a continuation of application No. PCT/JP93/00769, Jun. 8, 1993, abandoned.

[30] Foreign Application Priority Data

Jun. 10, 1992 [JP] Japan ..... 4-150773
Apr. 26, 1993 [JP] Japan ..... 5-099498

[51] Int. Cl.[6] ..... D21C 9/16

[52] U.S. Cl. ..... 162/72; 162/5; 162/6; 162/76; 162/78; 562/126; 564/30

[58] Field of Search ..... 162/72, 76, 79, 162/78, 5, 6; 562/126; 564/3, 26, 30, 17, 414

[56] References Cited

U.S. PATENT DOCUMENTS 2,783,272 2/1957 Young .
3,384,534 5/1968 Kindron et al. .
3,507,743 4/1970 Cartsunis et al. .
4,244,780 1/1981 Rende et al. .
4,427,490 1/1984 Eckert .
4,675,076 6/1987 Darlington .

FOREIGN PATENT DOCUMENTS 2-234991 9/1990 European Pat. Off. .
55-17339 2/1980 Japan .
58-39155 8/1983 Japan .
59-13756 1/1984 Japan .
61-194289 8/1986 Japan .
0 195 620 9/1986 Japan .
1-162887 6/1989 Japan .

OTHER PUBLICATIONS

Chemical Abstracts—American Chemical Society, vol. 79, No. 22, 127318W, (Dec. 3, 1973).
Zr. Org. Khim. 3(6), 1002–5 (1967) and English Abstract.
Zr. Org. Khim. 6(5), 947–9 (1970) and English Abstract.
Metody Poluch Khim. Reactiv. Prep. 1969, No. 20, 148–9 and Chemical Abstract.
Metody Poluch Khim. Reactiv. Prep. 1969, No. 20, 148–9 and Chemical Abstract.

*Primary Examiner*—Steve Alvo
*Attorney, Agent, or Firm*—Armstrong, Westerman, Hattori, McLeland & Naughton

[57] ABSTRACT

A process for producing a thiourea dioxide fluid by mixing thiourea and a peroxide, or thiourea, a peroxide and a reaction catalyst, or thiourea, a peroxide, a reaction catalyst and a chelating agent, in the absence or presence of pulp and a process for bleaching pulp by the use of the thiourea dioxide fluid produced by the above process economically advantageously with a small chemicals loss and by small consumption of energy.

6 Claims, No Drawings

PROCESS FOR PRODUCING THIOUREA DIOXIDE

This application is a divisional of application Ser. No. 08/788,027, filed Jan. 23, 1997, now abandoned, which is a continuation of application Ser. No. 08/539,824, filed Oct. 6, 1995, now abandoned, which is a continuation of application Ser. No. 08/182,027, filed Jan. 26, 1994, now abandoned which is a 371 of PCT/JP93/00769, filed Jun. 8, 1993.

TECHNICAL FIELD

The present invention relates to on-site production of thiourea dioxide usable mainly for bleaching pulp for papermaking, and a process for bleaching pulp for papermaking with thiourea dioxide (hereinafter referred to as TUDO) thus produced. More particularly, it provides an economical and efficient process for bleaching with TUDO in which TUDO is produced at a bleaching site and bleaching is carried out by adding the produced TUDO fluid or slurry TUDO to pulp, or in which bleaching is carried out while producing TUDO on pulp.

BACKGROUND ART

Bleaching of pulp for papermaking is roughly divided into bleaching with a peroxide, bleaching with a chlorine-containing oxidizing agent, and bleaching with a reducing agent, and these have been employed depending on the kind of pulp and purpose of use in consideration of their bleaching characteristics and effects.

The bleaching with a peroxide represented by $H_2O_2$ is employed mainly for bleaching of mechanical pulp and for deinking/bleaching of waste newspaper because of its bleaching effect on pulp containing lignin.

Since the bleaching with a chlorine-containing oxidizing agent is effective for chemical pulp containing a slight amount of lignin, bleaching with $Cl_2$, NaClO or $ClO_2$ is mainly carried out in multistage bleaching of kraft pulp, and bleaching with NaClO in bleaching of waste wood-free or mechanical paper. For example, in the bleaching of waste wood-free or mechanical paper, a 12% NaClO solution is added to pulp in an amount of about 8% based on the amount of pulp and mixed therewith, whereby the bleaching is carried out.

The bleaching with a reducing agent is excellent in decolonization of dye type coloring materials, but it has a limited-bleaching capability for peroxide type chemicals and chlorine-containing chemicals and entails a high cost. For these reasons and the like, it has been employed mainly for bleaching of mechanical pulp demanding a low brightness grade to be incorporated into newspaper, post-bleaching after $H_2O_2$ bleaching of mechanical pulp demanding a high brightness grade and post-bleaching after $H_2O_2$ deinking/bleaching of waste newspaper. In general, $Na_2S_2O_4$ or TUDO of the dithionite family has been used as the reducing agent. Of these, $Na_2S_2O_4$ has been mainly used from the viewpoint of bleaching capability, chemicals cost, etc. On the other hand, TUDO is a dithionite type reducing agent like $Na_2S_2O_4$, and has a bleaching effect equal to that of $Na_2S_2O_4$, but it has not been often used because it entails a high chemicals cost.

However, TUDO bleaching has recently come to be spotlighted as a substitute for NaClO bleaching in bleaching of waste wood-free or mechanical paper and as a substitute for $Na_2S_2O_4$ bleaching in post-bleaching after $H_2O_2$ deinking/bleaching of waste newspaper, from the viewpoint of the problem of waste water pollution by organic chlorine compounds represented by dioxins, demand for energy conservation, decoloring effect on dye type coloring materials, etc.

By the way, NaClO bleaching is not expensive and has an excellent decoloring capability for dye type coloring materials, and hence in bleaching of waste wood-free or mechanical paper, NaClO bleaching has heretofore been carried out by a process roughly co represented by the following:

[Pulper]→[Soaking/deinking]→[Washing]→[Kneading]→[NaClO bleaching]→[Washing]→[Papermaking steps]

However, because of the problem of production of organic chlorine compounds as by-products by employment of chlorine-containing chemicals, there has been a desire for development of a bleaching method as a substitute for bleaching with NaClO for the purpose of avoiding the production of the by-products. As substitute methods for NaClO bleaching, $H_2O_2$ bleaching, $Na_2S_2O_4$ bleaching, TUDO bleaching, etc. have been investigated. Of these, TUDO bleaching has come to be considered hopeful as a substitute for NaClO bleaching for the following reasons.

First, $H_2O_2$ bleaching has a sufficient bleaching effect on natural pigments by nature but has an insufficient decoloring effect on dye type coloring materials from leaflets and colored wood-free paper among waste wood-free or mechanical papers. Therefore, it is not sufficient as a substitute for NaClO bleaching.

$Na_2S_2O_4$ bleaching has a sufficient decoloring effect on dye type coloring materials by nature but is disadvantageous in that it is subject to oxidative decomposition by oxygen in air. Therefore, it requires a special bleaching apparatus which excludes air. When a presently used NaClO bleaching apparatus is diverted as it is, no satisfactory bleaching can be carried out owing to the influence of oxygen in air. Therefore, $Na_2S_2O_4$ bleaching is not suitable as a substitute for the NaClO bleaching. In detail, in the presently used NaClO bleaching equipment bleaching conditions are carried out at a state of pulp having a relatively high consistency of PC 10 to 30%. Accordingly, equipment from a chemicals-mixer to a bleaching tower are substantially located in a system open to air, and oxygen in air inhibits the bleaching effect of $Na_2S_2O_4$.

On the other hand, TUDO bleaching has a considerable decoloring effect on dye type coloring materials, like $Na_2S_2O_4$ bleaching, and TUDO has a property of reacting with oxygen in air slowly as compared with $Na_2S_2O_4$. Even when a presently used NaClO bleaching equipment is diverted as it is, a loss due to oxidative decomposition is relatively small and a bleach brightness equal to that attained by NaClO bleaching can be attained by choosing a suitable using amount of TUDO.

As post-bleaching after $H_2O_2$ deinking/bleaching of waste newspaper, $Na_2S_2O_4$ bleaching has been mainly employed from the viewpoint of chemicals cost. Conventional bleaching with $Na_2S_2O_4$ is carried out under conditions of a low pulp consistency of PC 3 to 5% and a temperature of 50–70° C. Since a large amount of thermal energy is required for adjusting the temperature to 50–70° C. at a low pulp consistency, bleaching at a state of pulp having a high consistency of PC 10 to 30% has recently come to be aimed at for energy conservation. In the bleaching at a state of pulp having a high consistency, contamination with air tends to occur as in the case of the aforesaid waste wood-free or mechanical paper, and hence there is a problem that no satisfactory effect can be obtained by $Na_2S_2O_4$ bleaching. For exhibition of the bleaching effect of $Na_2S_2O_4$, it is necessary to use a bleaching equipment capable of excluding air for preventing oxidative decomposition by air. In this case, a considerable equipment investment is necessary.

On the other hand, since TUDO undergoes relatively rarely oxidative decomposition by oxygen in air. TUDO bleaching is suitable for bleaching pulp having a high consistency by a usual equipment while achieving a saving in energy.

Since TUDO is characterized in that it undergoes oxidative decomposition by oxygen in air relatively rarely as described above, it has come to be considered hopeful as a substitute bleaching method for all NaClO bleaching of deinking pulp from waste wood-free or mechanical paper and $Na_2S_2O_4$ bleaching after $H_2O_2$ deinking/bleaching of waste newspaper.

However, TUDO bleaching, on the other hand, has the following defects. Current TUDO bleaching is carried out using powdery TUDO manufactured as product by a maker, and the cost of this bleaching treatment is high for the following reasons. For one thing, the TUDO powder is obtained by reacting a thiourea solution with $H_2O_2$ fluid and purifying the resulting TUDO fluid, followed by concentration and drying. In this case, expensive equipment for the reaction, purification, concentration and drying are necessary, and a large amount of energy is required for controlling the reaction and for the purification, concentration and drying. Moreover, a part of TUDO is decomposed and lost in the procedures of reaction and commercialization, and consequently the production cost of the chemical is very high in itself. Another problem is that when the powdery TUDO is dissolved at a bleaching site and added to pulp, a loss of its active ingredient by decomposition is caused by the influence of oxygen in air during the dissolution with stirring and the mixing with the pulp, so that the bleaching effect is lessened as much.

Thus, the treatment cost of TUDO bleaching is high from using TUDO product of high cost in prior art. In addition, during the transport, storage and use of a TUDO product, its loss is caused by gradual oxidative decomposition by oxygen in air. Therefore, in the bleaching industry, there is desired a TUDO bleaching process which is free from the above defects and is easy to apply and practice on the site.

DISCLOSURE OF THE INVENTION

An object of the present invention is to provide a TUDO bleaching process which causes only a small loss of chemicals, consumes only a small amount of energy, has a marked bleaching effect and is industrially useful, as a substitute for NaClO bleaching of deinking pulp from waste wood-free or mechanical paper, a substitute for post-bleaching with $Na_2S_2O_4$ after $H_2O_2$ deinking/bleaching of waste newspaper, or a process for bleaching of various waste papers, mechanical pulp, kraft pulp, etc. Another object of the present invention is to obtain TUDO for bleaching, at low cost at a bleaching site.

Since TUDO is produced mainly by reacting thiourea (abbreviated as TU) with a peroxide and the amount of TUDO used in practical bleaching of pulp is not very large, the present inventors conjectured that the bleaching cost can be greatly reduced by mixing TU and a peroxide at a bleaching site to produce a TUDO fluid or slurry TUDO and adding the TUDO fluid or slurry TUDO to pulp, or by adding TU and a peroxide to pulp and carrying out TUDO bleaching while producing TUDO on the pulp. In order to find the conditions under which secondary produced materials likely to be caused in on-site production and unreacted materials have no desirable influence on bleaching, the present inventors earnestly investigated in consideration of the reactivity of TU with peroxides, the stability of TUDO, the state of on-site bleaching equipment, conditions of carrying out TUDO bleaching, etc., and consequently found the following: when the amount of TUDO produced is in a usual range of the amount of TUDO used for bleaching, TUDO can easily be produced at low cost at a bleaching site, by mixing TU and a peroxide, or TU, a peroxide and a reaction catalyst, or TU, a peroxide, a reaction catalyst and a chelating agent; the bleaching effect of the produced TUDO does not involve any problem; the produced TUDO is mixed with pulp as it is in a solution state and hence hardly loses its active ingredient owing to oxygen in air; therefore TUDO bleaching can be carried out at a low bleaching cost. Thus, the present invention has been accomplished.

BEST MODE FOR CARRYING OUT THE INVENTION

That is, the present invention is a process for producing thiourea dioxide which is characterized by mixing thiourea, a peroxide and optionally a reaction catalyst composed of an oxo-acid of an element in any of groups IV, V and VI, or a salt thereof, to produce thiourea dioxide; and a process for bleaching pulp for papermaking with thiourea dioxide obtained by on-site production which is characterized by mixing thiourea and a peroxide, or thiourea, a peroxide and a reaction catalyst composed of an oxo-acid of an element in any of groups IV, V and VI, or a salt thereof, to produce a thiourea dioxide fluid, adding the produced fluid to the pulp directly without purifying and separating thiourea dioxide, and thereby carrying out bleaching.

In addition, the present invention relates to a process for bleaching pulp with a TUDO fluid produced from TU and a peroxide, or a process for adding TU and a peroxide to pulp individually and bleaching the pulp while producing TUDO on the pulp.

It is well known that the reaction of a peroxide with TU yields TUDO. When the produced TUDO is used for bleaching, a pulverized TUDO product obtained by purifying and separating TUDO from the reaction solution, followed by drying and pulverization, has heretofore been used in view of the presence of unreacted materials and secondary produced materials, the yield from reaction, etc. The present invention, however, has made it possible to bleach pulp by adding a reaction solution of TU and a peroxide to pulp directly without purifying and separating TUDO from the reaction solution. The present invention has also made it possible to bleach pulp while producing TUDO on the pulp by mixing TU, a peroxide and the pulp. The present invention permits bleaching equal or superior to that achieved by the use of the TUDO product obtained by purification, separation, and drying and pulverization. Thus, it can omit steps of purification, separation, drying and pulverization, transport, etc., so that it can provide a very inexpensive TUDO bleaching process.

Mere allowing a peroxide to act on TU gives TUDO but their reaction is not sufficient, so that the yield of TUDO as product is somewhat low. Therefore, large amount of TU and the peroxide are required for obtaining a sufficient bleaching effect. In the present invention, the yield of the product is markedly increased by the presence of a small amount of a reaction catalyst to approach a theoretical yield, so that more satisfactory bleaching can be carried out.

Although the presence of the reaction catalyst does not affect the bleaching reaction itself remarkably, it causes a coloring phenomenon a little in some cases. In this case, co-use of a chelating agent reduces the coloring and increases the yield, so that more satisfactory bleaching can be carried out.

As a process for producing TUDO, there is known in U.S. Pat. No. 2,783,272 a process in which TUDO is produced by allowing a peroxide to act on an aqueous TU solution while maintaining the pH of the reaction solution at 2 to 6. In this patent, the yield of TUDO as product is low, so that large amounts of TU and the peroxide as starting materials are needed. As a method for increasing the yield, addition of ammonium bicarbonate to the reaction solution has been proposed in Japanese Patent Examined Publication No. 58-39155. But, as a result of investigation by the present inventors, no marked yield-increasing effect could be obtained by the above method.

As pulps to which the bleaching process of the present invention is applicable, there are exemplified high yield pulp demanding a low brightness grade to be, for example, incorporated into newspaper, high yield pulp already bleached with $H_2O_2$ demanding a high brightness grade which is to be incorporated into wood-free or mechanical paper, waste newspaper pulp already deinking/bleaching with $H_2O_2$, waste wood-free or mechanical paper pulp, and semi-bleached chemical pulp. In general, said bleaching process is applicable also to pulp bleached with $Na_2S_2O_4$ or TUDO and pulp bleached with $H_2O_2$ or NaClO.

In addition, the process of the present invention is applicable not only to bleaching of pulp but also to fields in which $Na_2S_2O_4$ or TUDO treatment such as dyeing or bleaching of fiber is carried out.

Furthermore, the process for producing of TUDO as present invention can be applied not only to production at a bleaching site but also to production in other places, and no trouble is caused even when TUDO is produced in the other place, transported to a using place such as a bleaching site, and then used.

TU in the present invention is used in a solid state or in the form of a slurry or an aqueous solution, and the amount of TU is chosen depending on the amount of the product TUDO needed. For on-site TUDO production, TU is used practically in an amount of 1 to 100 g, preferably 7 to 40 g, per liter of a TUDO fluid to be produced. However, no particular trouble is caused even when the amount of TU is beyond or below the above range. When TU is added to pulp as it is and the pulp is bleached while producing TUDO on the pulp, a weight percentage of 0.03 to 1.8% based on the weight of absolute dry pulp is sufficient as the amount of TU used because the amount of TUDO required for bleaching is generally 0.05 to 2.5% based on the bone dry weight of pulp.

As the peroxide used in the present invention, there can be used various inorganic or organic peroxide such as $H_2O_2$, $Na_2O_2$, peracetic acid, performic acid and various $H_2O_2$ addition compounds, and aqueous solutions thereof. Preferably, $H_2O_2$ is used.

The peroxide is used in an amount corresponding to the amount of TU and its using amount is such that the molar ratio of the peroxide in terms of 100% $H_2O_2$ to TU is 1.0 to 3.0, preferably 1.5 to 2.0. When the peroxide is used in an amount beyond the above range, the excess peroxide reacts with the produced TUDO, so that the produced TUDO is decomposed to disappear. When the peroxide is used in an amount below the above range, the amount of unreacted TU is increased, so that a loss is caused as much.

As the reaction catalyst used in the present invention, an oxo-acid of an element in group IV, V or VI, or a salt thereof is used. Typical examples of the reaction catalyst are various oxo-acid of tungsten, molybdenum, vanadium, selenium and titanium, or salts thereof. The salts include salts with alkali metals, alkaline earth metals, ammonium salts, etc. At least one of the above compounds is used. For example, tungstic acid and salts thereof include $H_2WO_2$ and its sodium salt, calcium salt and ammonium salt, etc. Molybdic acid and salts thereof include $H_2MoO_4$, $H_2Mo_2O_7$, $H_6Mo_7O_{24}$ and their sodium salts, calcium salts, ammonium salts, etc. Vanadic acid and salts thereof include $HVO_3$, $H_3VO_4$, $H_4V_2O_7$ and their sodium salts, calcium salts, ammonium salts, etc. Selenic acid and salts thereof include $H_2SeO_4$ and its sodium salt, calcium salt and ammonium salt, etc. Titanic acid and salts thereof include $H_2TiO_3$, $H_4TiO_4$ and their sodium salts, calcium salts, ammonium salts, etc.

The amount of the catalyst used is varied depending on the molecular weight of the catalyst and the amount of TUDO required to be produced, though in the case of a TUDO fluid obtained by on-site production, the amount is 1 to 2000 mg, preferably 5 to 200 mg, per liter of the TUDO fluid to be produced. When TU, $H_2O_2$ and the catalyst are added to pulp as such and the pulp is bleached while producing TUDO on the pulp, the catalyst is used in an amount of $1\times10^{-6}$ to 0.5%, preferably $5\times10^{-6}$ to $5\times10^{-2}$%, based on the bone dry weight of pulp.

As the chelating agent used in the present invention, there is used at least one member selected from the group consisting of aminocarboxylate type chelating agents, polyphosphoric acid type chelating agents, and aminoalkylphosphoric acid type chelating agents represented by the following formula (I):

$$(X_2O_3PCH_2)_2.N.\{(CH_2)_m.N.CH_2PO_3X_2\}_n.CH_2PO_3X_2 \quad (I)$$

wherein X is hydrogen, ammonium or an alkali metal, m is an integer of 2 to 3, and n is an integer of 0 or 1 to 3.

Specifically, the aminocarboxylate type chelating agents include ethylenediaminetetraacetic acid (EDTA), diethylenetriaminepentaacetic acid (DTPA), N-hydroxyethylethylenediamine-N,N',N"-triacetic acid (HEDTA), nitrilotriacetic acid (NTA), cyclohexanediaminetetraacetic acid (CyDTA), salts thereof, etc.; the aminoalkylphosphoric acid type chelating agents include aminotrimethylenephosphonic acid (ATMP), ethylenediaminetetramethylenephosphonic acid (EDTMP), diethylenetriaminepentamethylenephosphonic acid (DTPMP), propylenediaminetetramethylenephosphonic acid (PDTMP), dipropylenetriaminepentamethylenephosphonic acid (DPTPMP), salts thereof, etc.; and polyphosphoric acid type chelating agents include pyrophosphoric acid, tripolyphosphoric acid, trimetaphosphoric acid, tetratimetaphosphoric acid, hexametaphosphoric acid, salts thereof, etc.

The amount of the chelating agent used is varied depending on the molecular weight of the chelating agent and the amount of TUDO required to be produced, though in the case of a TUDO fluid obtained by on-site production, the amount is 5 to 4000 mg, preferably 20 to 1000 mg, per liter of the TUDO fluid to be produced. When TU, $H_2O_2$, the reaction catalyst and the chelating agent are added to pulp as such and the pulp is bleached while producing TUDO on the pulp, the chelating agent is used in an amount of $5\times10^{-6}$ to 1.0%, preferably $20\times10^{-6}$ to 0.25% based on the bone dry weight of pulp.

Although the pH of solution at the production of TUDO need not be particularly adjusted, it is preferably adjusted to 1 to 4, more preferably 2 to 3, at the completion of the reaction.

Next, for obtaining a satisfactory bleaching effect by TUDO bleaching, it is usually preferable to adjust the pH at the initial bleaching to approximately 9–11. When the pH of pulp to be bleached is outside this range, there is usually employed a method in which the pH is adjusted to a pH preferable for TUDO bleaching, by adding an alkali agent to the pulp previously. As another method, it is also possible to adjust the pH at the initial bleaching to 9 or higher by adding an alkali agent at the time producing TUDO fluid and at the time of bleaching the pulp while producing TUDO on the pulp.

The alkali agent in this case includes, for example, strongly basic alkali agents such as sodium hydroxide and the like, their aqueous solutions, weakly basic alkali agents such as sodium carbonate, sodium borate, sodium silicate, sodium phosphate, sodium polyphosphate and the like, and their aqueous solutions. Any alkali agent may be used so long as it is a compound having an alkaline action.

The amount of the alkali agent used is varied depending on the pH state of pulp and the alkalinity of the alkali agent used, and the alkali agent is used in such an amount that the pH at the initial bleaching reaction becomes 9 to 11. When the pH of pulp to be bleached is already in the range of 9 to 11, or when pH of the pulp is adjusted previously and separately for TUDO bleaching, the above alkali addition procedure is not necessary.

Next, as an equipment for mixing and reacting chemicals for producing a TUDO fluid and an equipment for mixing chemicals with pulp, any equipment may be used so long as they permit uniform mixing reaction and uniform and rapid diffusion of the chemicals into the pulp, and there is used a combination of conventional equipment such as a chemicals-mixing tank, static mixer, in-line mixer, kneader, diffuser, twin rotor mixer, etc.

In the case of a process for producing a TUDO fluid, there are thought of a process comprising once storing a produced TUDO fluid in a stocking tank and adding the fluid to pulp gradually to bleach the pulp; and a process in which while producing a TUDO fluid continuously by the use of a static mixer, in-line mixer, cascade-type chemicals mixing reaction machine, etc., pulp is bleached by adding the produced TUDO to the pulp continuously. Either of these methods may be employed.

Cooling is not always necessary for producing a TUDO fluid, though since it is an exothermic reaction, the production may be carried out preferably while cooling the reaction solution to 5–80° C., more preferably 20–60° C. and with sealing with $N_2$ gas or $CO_2$ gas for preventing contamination with oxygen in air.

Next, as to bleaching conditions for pulp other than the amounts of chemicals used and their mixing method and adding method, the bleaching is carried out under conventional $Na_2S_2O_4$ bleaching conditions or TUDO bleaching conditions.

For example, the pulp consistency to be applicable for bleaching is from low consistencies of PC 3 to 5% for conventional $Na_2S_2O_4$ bleaching to high consistencies of PC 20% or more employed for recent TUDO bleaching. Although depending on the kind of pulp and the purpose of bleaching, the bleaching temperature is usually room temperature or higher, preferably 40–100° C., and the bleaching time is 5 minutes or more, preferably 30 to 120 minutes. These conditions are chosen depending on the kind of pulp, the purpose of bleaching, and the shape and situation of a bleaching apparatus and hence are not critical.

A bleaching equipment usable in the present invention is applicable to any equipment so long as it is a conventional type equipment used for $Na_2S_2O_4$ bleaching, TUDO bleaching, NaClO bleaching or $H_2O_2$ bleaching.

The present invention permits marked reduction of the bleaching cost as compared with a conventional process in which bleaching is carried out by purchasing an expensive TUDO product, because the present invention is a process which uses relatively inexpensive single TU and peroxide as starting materials for TUDO, does not require an expensive equipment, gives TUDO mainly by on-site production, and uses the TUDO for bleaching without purifying and separating the TUDO. In addition, according to the process of the present invention, treatment costs can be greatly reduced not only in bleaching of pulp but also in fields in which TUDO treatments such as dyeing and bleaching of fiber are carried out.

EXAMPLES

The present invention is illustrated below in further detail with examples and comparative examples. Needless to say, the present invention is not limited at all by the examples described below. Details of the concentrations of chemicals, the brightness, the abbreviations of the kind of pulp, etc. in the examples and the comparative examples are as follows.

① Concentrations of chemicals:

g/liter in the case of the production of a TUDO fluid, and

% by weight based on the bone dry weight of pulp in the case of addition to pulp.

② Brightness:

Pulp after the completion of bleaching was collected in an amount of 15 g based on bone dry weight diluted to PC 1.0% with ion-exchanged water to be dis-aggregated, and then adjusted to pH 5.0 with an aqueous sulfurous acid solution. Thereafter, the diluted pulp solution was filtered by suction, made into two pulp sheets, and then air-dried overnight, after which the brightness was measured according to JIS-P8123 (a method for measuring brightness by Hunter).

③ Abbreviations of the kind of pulp:

TMP: thermomechanical pulp—a kind of high yield pulp.

Waste newspaper DIP: pulp obtained by deinking from waste newspaper.

Waste wood-free or mechanical paper DIP: pulp obtained by deinking from waste wood-free or mechanical paper.

④ Reducing equivalent ratio of TUDO to $Na_2S_2O_4$:

When each of the two compounds is hydrolyzed as follows in an aqueous solution, the amount of $H_2SO_2$ assumed to be produced is the same equivalent weight per mole of the compound.

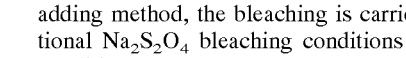

$$(NH_2)_2CSO_2+H_2O=(NH_2)_2CO+H_2SO_2$$

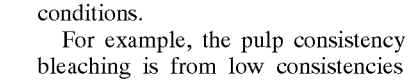

$$Na_2S_2O_4+H_2O=Na_2SO_3+H_2SO_2$$

Therefore the reducing equivalent ratio between them by weight is as follows:

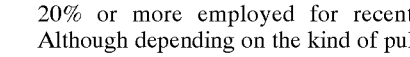

$$TUDO:Na_2S_2O_4=1:0.62$$

Examples 1 to 6 (Production of a TUDO Fluid)

One liter of a TUDO fluid was produced by adding 36 g of 35% $H_2O_2$ to an aqueous solution containing 14.1 g of TU and 50 mg of one of the following catalysts, in order to adjust the theoretical concentration of TUDO produced to 20 g/liter, and mixing them. The results are shown in Table 1.

① $Na_4TiO_4$, ② $Na_2SeO_4$, ③ $NaVO_3$, ④ $Na_2WO_4$, ⑤ $Na_2MoO_4$, ⑥ $(NH_4)Mo_7O_{24}$.

Comparative Example 1 (Production of a TUDO Fluid)

A TUDO fluid was produced in the same manner as in Example 1, except that the catalyst was not present. The result is shown in Table 1.

Comparative Example 2 (Production of a TUDO Fluid)

One liter of a TUDO fluid was produced by adding 36 g of 35% $H_2O_2$ to an aqueous solution containing 14.1 g of TU and 1.46 g of ammnonium bicarbonate, in order to adjust the theoretical concentration of TUDO produced to 20 g/liter, and mixing them. The result is shown in Table 1.

TABLE 1

| | Catalyst | Amount of TUDO produced (Yield of product) |
|---|---|---|
| Example 1 | ① $Na_4TiO_4$ | 18.50 g/L (92.5%) |
| Example 2 | ② $Na_2SeO_4$ | 19.02 g/L (95.1%) |
| Example 3 | ③ $NaVO_3$ | 18.88 g/L (94.4%) |
| Example 4 | ④ $Na_2WO_4$ | 19.28 g/L (96.4%) |
| Example 5 | ⑤ $Na_2MoO_4$ | 18.38 g/L (91.9%) |
| Example 6 | ⑥ $(NH_4)Mo_7O_{24}$ | 17.98 g/L (89.9%) |
| Comparative Example 1 | No catalyst | 14.92 g/L (74.6%) |
| Comparative Example 2 | Ammonium bicarbonate | 13.51 g/L (67.9%) |

Examples 7 to 11 (Production of a TUDO Fluid)

One liter of a TUDO fluid was produced by adding 63.0 g of 35% $H_2O_2$ to an aqueous solution containing 24.7 g of TU, 100 mg of $NaVO_3$ as catalyst and 400 mg of each of the following chelating agents, in order to adjust the theoretical concentration of TUDO produced to 35 g/liter, and mixing them. The results are shown in Table 2.

① EDTA.4Na, ② DTPA.5Na, ③ EDTMP.4Na, ④ DTPMP.5Na, ⑤ Na tripolyphosphate.

Example 12 (Production of a TUDO Fluid)

A TUDO fluid was produced in the same manner as in Example 7, except that the chelating agent was not present. The result is shown in Table 2.

Comparative Example 3 (Production of a TUDO Fluid)

A TUDO fluid was produced in the same manner as in Example 7, except that neither the chelating agent nor the catalyst was present. The result is shown in 5 Table 2.

TABLE 2

| | Catalyst | Color of fluid | Amount of TUDO produced (Yield of product) |
|---|---|---|---|
| Example 7 | ① EDTA.4Na | Slightly blue | 33.22 g/L (94.9%) |
| Example 8 | ② DTPA.5Na | Slightly blue | 34.30 g/L (98.0%) |
| Example 9 | ③ EDTMP.4Na | Slightly blue | 33.78 g/L (96.5%) |
| Example 10 | ④ DTPMP.5Na | Slightly blue | 33.57 g/L (95.9%) |

TABLE 2-continued

| | Catalyst | Color of fluid | Amount of TUDO produced (Yield of product) |
|---|---|---|---|
| Example 11 | ⑤ Na tripoly-phosphate. | Slightly blue | 33.35 g/L (95.4%) |
| Example 12 | ⑥ No chelat-ing agent | Dark blue | 32.69 g/L (93.4%) |
| Comparative Example 3 | No chelating agent and no catalyst | Colorless | 24.36 g/L (69.9%) |

Example 13 (Bleaching of Pulp with a TUDO Fluid Obtained by On-Site Production)

$Na_2CO_3$ was added to a slurry of unbleached TMP (brightness: 49.3%) for newspaper which had a pH of 5.5 and a PC of 4%, to adjust the PH at initial bleaching to 10, after which the on-site TUDO fluid produced in Comparative Example 1 was added in an amount of 0.55% (in terms of 100% solids) based on the bone dry weight of the pulp, followed by mixing, and bleaching was carried out at 60° C. for 90 minutes. The result is shown in Table 3.

Example 14 (Bleaching of Pulp with a TUDO Fluid Obtained by On-Site Production)

The same bleaching as in Example 13 was carried out except that in place of the on-site TUDO fluid produced in Comparative Example 1, the on-site TUDO fluid produced in Example 1 was used in an amount of 0.55% (in terms of 100% solids) based on the bone dry weight of the pulp. The result is shown in Table 3.

Comparative Example 4 (Bleaching with a Commercial TUDO Product)

The same bleaching as in Example 13 was carried out except that in place of the TUDO fluid obtained by on-site production, there were added a commercial TUDO product (mfd. by DEGUSSA; purity 99.55%) in an amount of 0.55% (in terms of 100% solids) based on the bone dry weight of the pulp, and $Na_2CO_3$ in such an amount that the pH at the initial TUDO bleaching became 10. The result is shown in Table 3.

Comparative Example 5 ($Na_2S_2O_4$ bleaching)

In place of TUDO, $Na_2S_2O_4$ powder (mfd. by Mitsubishi Gas Chemical Co., Inc.; purity 85%) having the same reducing equivalent as that of TUDO was added to a slurry of the same unbleached TMP as in Example 13 which had a pH of 5.5 and a PC of 4%, in an amount of 1.1% based on the bone dry weight of the pulp, followed by mixing, after which bleaching was carried out at 60° C. for 90 minutes. The result is shown in Table 3.

Example 15 (Bleaching of Pulp with a TUDO Fluid Obtained by On-Site Production)

To a slurry of waste newspaper DIP for wood-free or mechanical paper that had been deinking/bleaching with $H_2O_2$ by the process of deinking/bleaching described below (brightness: 68.1%) which slurry had a pH of 7.5 and a PC of 25%, there were added in a system open to air the on-site TUDO fluid produced in Comparative Example 3 in an amount of 0.27% (in terms of 100% TUDO solids) based on the bone dry weight of the pulp and NaOH in an amount of 0.3% based on the bone dry weight of the pulp, followed by mixing, and bleaching was carried out at PC 20% and 70° C. for 60 minutes. The result is shown in Table 3.

[Pulping]→[Dilution and dehydration]→[Kneading]→[Chemicals mixing]→[$H_2O_2$ soaking/deinking/bleaching]→[Flotation]→[Washing]→[Dehydration (PC 25%)]

Example 16 (Bleaching of Pulp with a TUDO Fluid Obtained by On-Site Production)

The same bleaching as in Example 15 was carried out except that in place of the on-site TUDO fluid produced in Comparative Example 3, the on-site TUDO fluid produced in Example 8 was used in an amount of 0.27% (in terms of 100% TUDO solids) based on the bone dry weight of the pulp. The result is shown in Table 3.

Comparative Example 6 (Bleaching with a Commercial TUDO Product)

The same bleaching as in Example 15 was carried out except that in place of the TUDO fluid obtained by on-site production,sa commercial TUDO product having the same reducing equivalent as that of the TUDO fluid was added in an amount of 0.27% (in terms of 100% TUDO solids) based on the bone dry weight of the pulp. The result is shown in Table 3.

Comparative Example 7 ($Na_2S_2O_4$ Bleaching)

The same bleaching as in Example 15 was carried out except that in place of the TUDO fluid obtained by on-site production and NaOH, 85% $Na_2S_2O_4$ powder having the same reducing equivalent as that of the TUDO fluid was added in an amount of 0.55% based on the bone dry weight of the pulp. The result is shown in Table 3. During the bleaching, the bad odor of decomposed product of $Na_2S_2O_4$ by air oxidation hung around, so that the work environment was markedly worsened.

Example 17 (Production of TUDO and Bleaching therewith on Pulp)

To a slurry of waste wood-free or mechanical DIP for paper for domestic use that had been deinking by the deinking process described below (brightness; 71.0%) which slurry had a pH of 11.0 and a PC of 30%, thiourea and 35% $H_2O_2$ were added in amounts of 1.10% and 2.81%, respectively, based on the bone dry weight of the pulp, followed by mixing, and bleaching was carried out at 60° C. for 180 minutes. The result is shown in Table 3.

[Pulping]→[Alkali soaking/deinking]→[Flotation]→[Washing]→[Dehydration (PC 30%)]

Example 18 (Production of TUDO and Bleaching therewith on Pulp)

The same bleaching as in Example 17 was carried out except that in place of thiourea and 35% $H_2O_2$ in amounts of 1.10% and 2.81%, respectively, there were used thiourea, 35% $H_2O_2$, $Na_2SeO_4$ as reaction catalyst and Na tripolyphosphate in amounts of 0.8%, 2.05%, 0.001% and 0.005%, respectively, which were such that the amount of TUDO produced was equal to that in Example 17. The result is shown in Table 3.

Comparative Example 8 (Bleaching with a Commercial TUDO Product)

The same bleaching as in Example 17 was carried out except that in place of thiourea and $H_2O_2$, a commercial TUDO product was used in an amount of 1.08% which was such that the reducing equivalent of the TUDO product was the same as that corresponding to the amount of the commercial TUDO obtained by on-site production in Example 17. The result is shown in Table 3.

Comparative Example 9 ($Na_2S_2O_4$ Bleaching)

The same waste wood-free or mechanical paper DIP as in Example 17 was adjusted to pH 6 with an aqueous sulfurous acid solution, after which in place of thiourea and $H_2O_2$ in Example 17, 85% $Na_2S_2O_4$ powder was added in an amount of 2.05% based on the amount of the pulp which was such that the reducing equivalent of the 85% $Na_2S_2O_4$ powder was the same as that corresponding to the amount of the TUDO obtained by on-site production, followed by mixing, and bleaching was carried out at 60° C. for 180 minutes. The result is shown in Table 3.

Comparative Example 10 (Current NaClO Bleaching)

In place of thiourea and $H_2O_2$ in Example 17, a 12% NaClO solution was added to same slurry of waste wood free or mechanical paper DIP in an amount of 8% based on the bone dry weight of the pulp, followed by mixing, and bleaching was carried out at ordinary temperature for 180 minutes. The result is shown in Table 3.

TABLE 3

| Example/ Comparative Example | Kind of pulp to be bleached | Bleaching agent | Brightness % |
|---|---|---|---|
| Example 13 | TMP | On-site production TUDO | 55.9% |
| Example 14 | TMP | On-site production TUDO | 56.1% |
| Compartive Example 4 | TMP | Product TUDO | 55.5% |
| Comparative Example 5 | TMP | $Na_2S_2O_4$ | 55.9% |
| Example 15 | Waste newspaper DIP | On-side production TUDO | 72.0% |
| Example 16 | Waste newspaper DIP | On-site production TUDO | 72.4% |
| Comparative Example 6 | Waste newspaper DIP | Product TUDO | 71.8% |
| Comparative Example 7 | Waste newspaper DIP | $Na_2S_2O_4$ | 69.5% |
| Example 17 | Waste wood-free or paper DIP | On-site production TUDO | 76.8% |
| Example 18 | Waste wood-free or paper DIP | On-site production TUDO | 77.2% |
| Comparative Example 8 | Waste wood-free or paper DIP | Product TUDO | 76.7% |
| Comparative Example 9 | Waste wood-free or paper DIP | $Na_2S_2O_4$ | 73.4% |
| Comparative Example 10 | Waste wood-free or paper DIP | NaClO | 77.2% |

INDUSTRIAL APPLICABILITY

The effects of the present invention are explained below.

According to the present invention, a TUDO fluid is produced at a bleaching site and the produced TUDO fluid can be directly used for bleaching without purifying and separating TUDO, and hence inexpensive TUDO bleaching can be carried out.

In addition, according to the present invention, addition of a small amount of a reaction catalyst and further addition of a small amount of a chelating agent increase the yield from reaction, make it possible to produce TUDO on the site at low cost, and permit more inexpensive TUDO bleaching.

According to the present invention, it is possible to carry out bleaching which has a bleaching effect larger than that of bleaching with a commercial TUDO product, on bleaching of TMP demanding a low brightness grade to be incorporated into newspaper, and is as effective as $Na_2S_2O_4$ bleaching. In the process of the present invention, a bad odor is hardly emitted owing to decomposition, unlike in $Na_2S_2O_4$ bleaching, and hence the said process shows its great merit also in work environment.

According to the process of the present invention, the influence of oxygen in air is avoided to a considerable extent in bleaching of waste newspaper DIP for wood-free or mechanical paper, the bleaching effect is larger than that obtained using a commercial TUDO product or $Na_2S_2O_4$, the cost of TUDO itself becomes very low because TUDO is produced at a bleaching site, and the cost of chemicals for TUDO bleaching can be greatly reduced. Bleaching treatment of pulp having a high consistency is known to be advantageous for achieving a saving in thermal energy. When the present invention is applied to the bleaching treatment of pulp having a high consistency, there can be carried out effective and inexpensive TUDO bleaching which is highly resistant to oxygen in air, and hence the significance of the achievement of a saving in thermal energy is further increased.

According to the process of the present invention, bleaching substantially equal to current NaClO bleaching can be carried out at a low bleaching chemicals cost, in waste wood-free or mechanical paper DIP for papers for domestic use (e.g. toilet paper), and it is possible to avoid the production of an organic chlorine compound which is a serious problem in NaClO bleaching.

As described above, according to the present invention, TUDO can be obtained at a bleaching site efficiently at low cost, and the produced TUDO can be effectively used in a bleaching procedure substantially without its decomposition by oxygen in air. Consequently, bleaching can be carried out at a low chemicals cost and a low thermal energy cost, bleaching of waste wood-free or mechanical paper pulp which is substantially equal to current NaClO bleaching can be carried out at a low bleaching cost even in an equipment open to air, such as a presently used NaClO bleaching equipment, and the production of an organic chlorine compound as by-product can be avoided unlike in NaClO bleaching.

Needless to say, TUDO produced by the present inventive production process of TUDO using a catalyst is more inexpensive than that produced by a conventional process, and it can be used as TUDO to be put on the market, after separated and purified.

We claim:

1. A process for producing thiourea dioxide, characterized by mixing thiourea, a peroxide and at least one reaction catalyst wherein the reaction catalyst is an oxo-acid of tungsten, molybdenum, vanadium, selenium and titanium or salts thereof, to produce thiourea dioxide with a high yield in the absence of pulp.

2. A process for producing thiourea dioxide according to claim 1, wherein a chelating agent is added at the time of the production of thiourea dioxide, and the chelating agent is at least one member selected from the group consisting of aminocarboxylate type chelating agents, polyphosphoric acid type chelating agents, and aminoalkyiphosphoric acid type chelating agents represented by the following formula (I):

$$(X_2O_3PCH_2)_2{\bullet}N{\bullet}\{(CH_2)_m{\bullet}N{\bullet}CH_2PO_3X_2\}_n{\bullet}CH_2PO_3X_2 \quad \text{(I)}$$

wherein X is hydrogen, ammonium or an alkali metal, m is an integer of 2 to 3, and n is an integer of 0 to 3.

3. A process for producing thiourea dioxide according to claim 2 wherein the amount of the chelating agent is 5 to 4000 mg per liter of the thiourea dioxide fluid.

4. A process for producing thiourea dioxide according to claim 1 wherein the amount of the peroxide is 1.0 to 3.0 moles per mole of thiourea.

5. A process for producing thiourea dioxide according to claim 1 wherein the amount of the reaction catalyst is 1 to 2000 mg per liter of the thiourea dioxide fluid.

6. A process for producing thiourea dioxide according to claim 1, wherein the pH of solution at the production of the thiourea dioxide is 1 to 4 at the completion of the reaction.

* * * * *